US006204462B1

(12) United States Patent
Huang

(10) Patent No.: US 6,204,462 B1
(45) Date of Patent: Mar. 20, 2001

(54) STABLE KEYSWITCH

(75) Inventor: Gear Huang, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/536,796

(22) Filed: Mar. 28, 2000

(51) Int. Cl.[7] ..... H01H 3/12
(52) U.S. Cl. ..... 200/345
(58) Field of Search ..... 200/54, 517, 341, 200/344, 345; 400/490, 491.2, 495, 495.1, 496

(56) References Cited

U.S. PATENT DOCUMENTS 4,556,769 * 12/1985 Inaba ..... 200/340
5,406,277 * 4/1995 Lee ..... 341/22
5,496,982 * 3/1996 Tsai ..... 200/345
5,710,397 * 1/1998 Liao ..... 200/5 A
5,907,612 * 5/1999 Aggus et al. ..... 379/368
5,938,009 * 8/1999 Huang ..... 200/517
6,056,456 * 5/2000 Kinoshita ..... 400/472

* cited by examiner

*Primary Examiner*—Michael Friedhofer
(74) *Attorney, Agent, or Firm*—Rosenberg, Klein & Lee

(57) ABSTRACT

An improved keyswitch comprises a stage having a mounting hole and a keycap having a plunger on bottom thereof. The plunger is movably arranged within the plunger. At least one guiding rib is provided within the stage or on lateral side of the keycap; and at least one groove corresponding to the guiding rib is provided on lateral side of the keycap or within the stage, the guiding rib fit within the groove such that the keycap is movable upward and downward within the mounting hole without shaking. The keycap is in contact with the stage on lateral side thereof, the friction therebetween is reduced.

4 Claims, 8 Drawing Sheets

STABLE KEYSWITCH

FIELD OF THE INVENTION

The present invention relates to a stable keyswitch, especially to a stable keyswitch, which will not shake during operation and has compact height.

BACKGROUND OF THE INVENTION

As shown in FIG. 1, a conventional keyswitch comprises a keycap 10*a* and a stage 11*a*. The stage 11*a* has a mounting hole 12*a* on center thereof. The keycap 10*a* has a plunger 13*a* on bottom thereof and movably fit within the mounting hole 12*a*. When the keycap 10*a* is pressed to lower down the plunger 13*a*, the pressing end 15*a* of the rubber cone 14*a* touches the flexible circuit 16*a* on the base plate 17*a* to switch on the flexible circuit 16*a*. When the keycap 10*a* is released, the pressing end 15*a* of the rubber cone 14*a* leaves the flexible circuit 40 due to the elasticity of the rubber cone 30, thus switching off the flexible circuit 40. However, the above mentioned keyswitch has relatively large height and keycap is unstable if the height of the keyswitch is reduced without careful design.

It is an object of the present invention to provide a stable keyswitch wherein the keycap has restrict vertical movement within the stage, thus having more stability. The friction between the keycap and the stage is reduced.

To achieve the above objects, in the inventive keyswitch, at least one guiding rib is provided within the stage or on lateral side of the keycap; and at least one groove corresponding to the guiding rib is provided on lateral side of the keycap or within the stage, the guiding rib fit within the groove such that the keycap is movable upward and downward within the mounting hole without shaking. The keycap is in contact with the stage on lateral side thereof, the friction therebetween is reduced.

The various objects and advantages of the present invention will be more readily understood from the following detailed description when read in conjunction with the appended drawing, in which:

DETAIL DESCRIPTION OF PREFERRED EMBODIMENT

Figure 4:
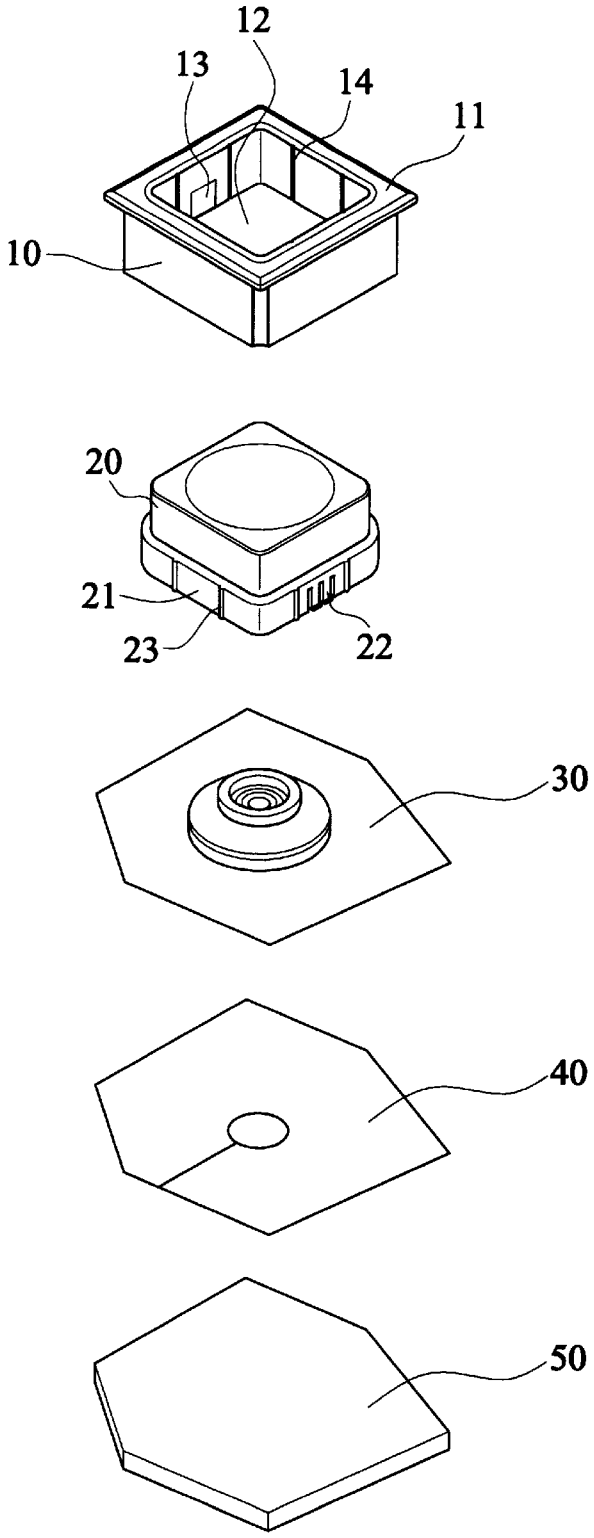
FIG. 4 is an exploded view of the present invention.
Figure 5:
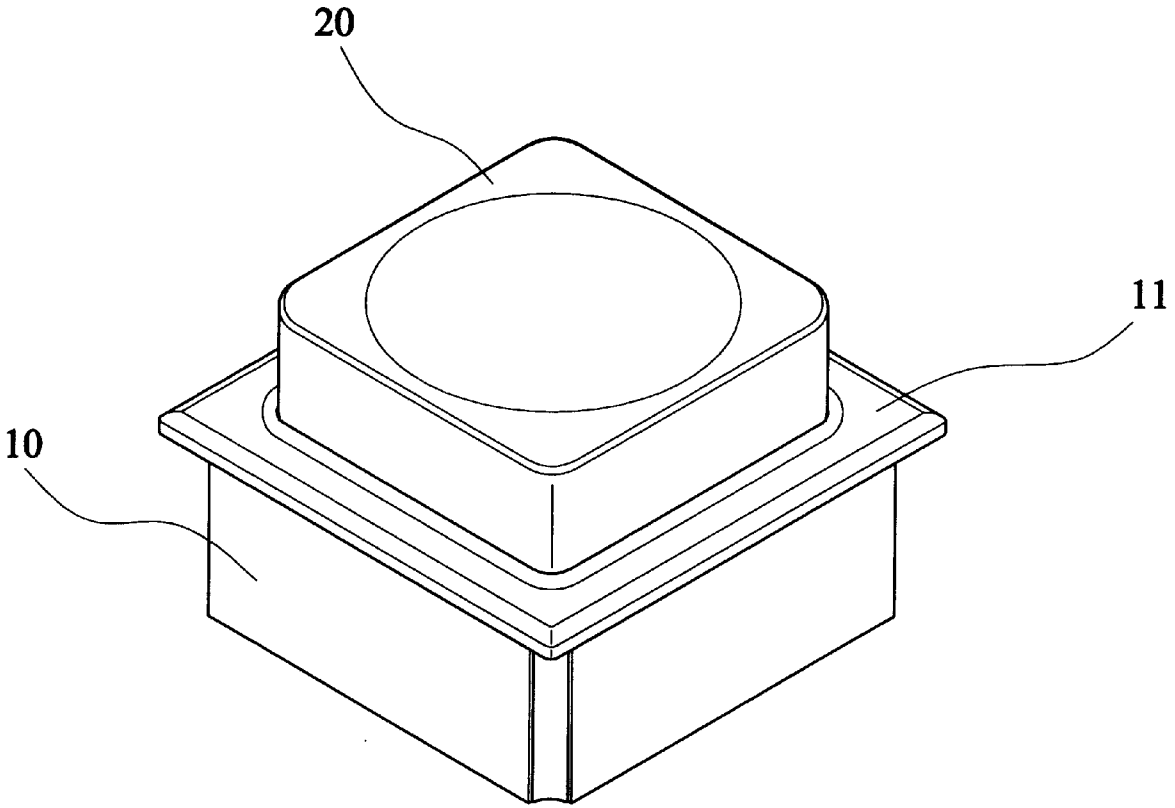
FIG. 5 is a perspective view of the present invention.

FIGS. 4 and 5 show a preferred embodiment of the present invention, the keyswitch comprises a stage 10 and a keycap 20. The stage 10 is a hollow tube and formed on a base 11. The stage 10 has a mounting hole 12 on center thereof and two mute bevels 13 on two inner sides of the mounting hole 12 as shown in FIG. 4. Moreover, the mounting hole 12 has at least one guiding groove 14 on inner sidewall thereof. In this embodiment, the mounting hole 12 has eight guiding grooves 14 on four inner sidewalls thereof.

Figure 1:
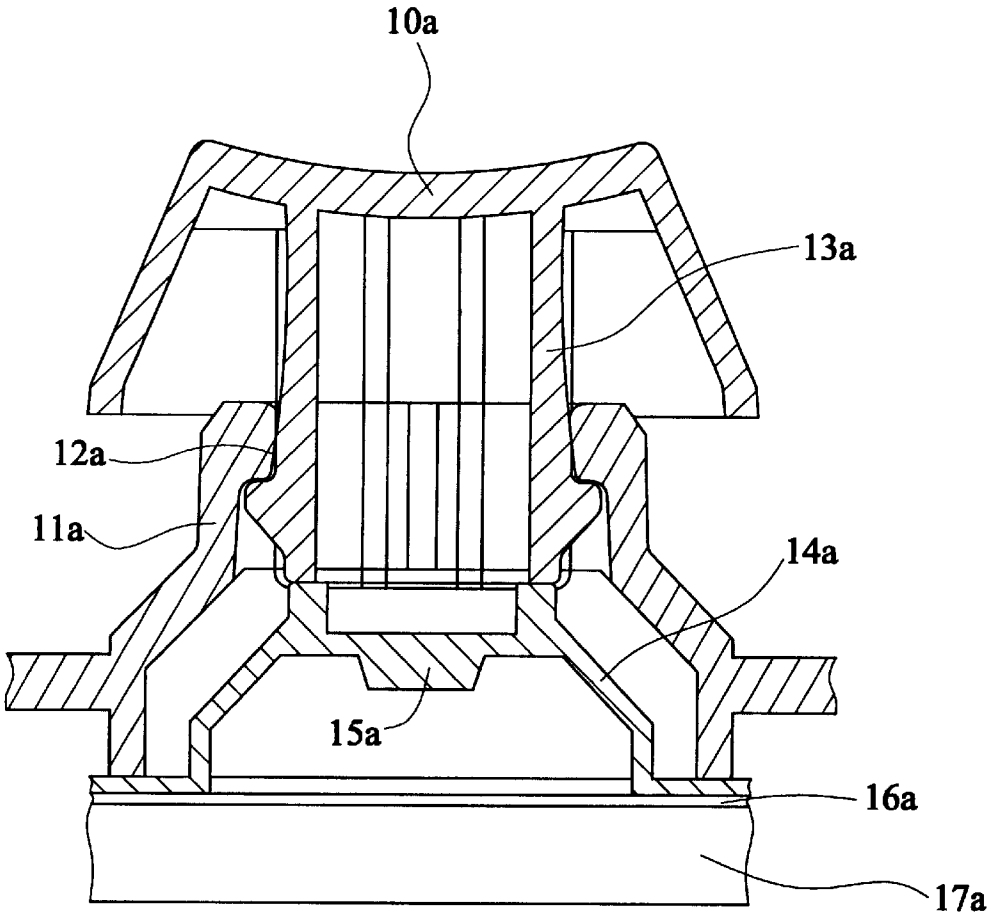
FIG.1 PRIOR ART
FIG. 1 is a sectional view of prior art keyswitch.
Figure 2:
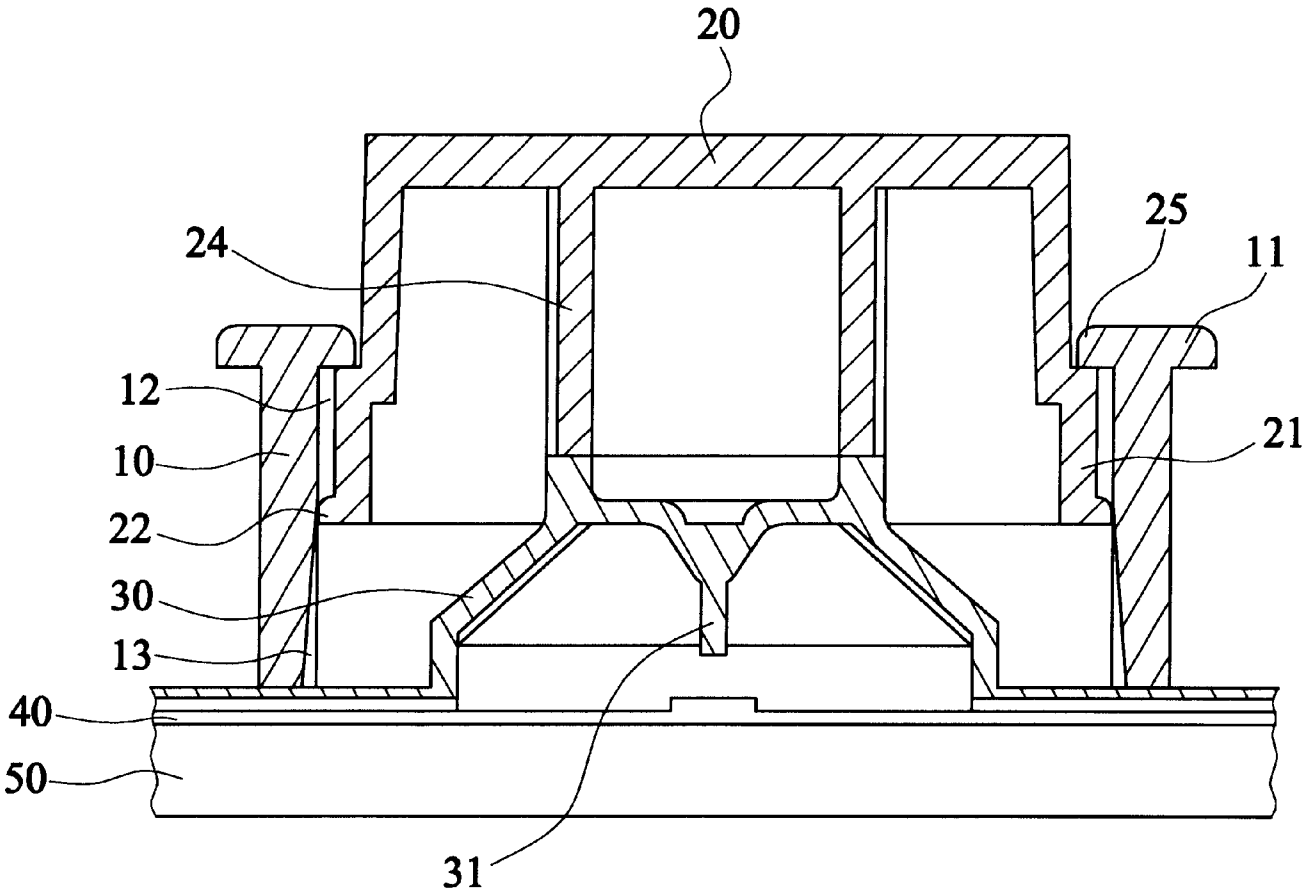
FIG. 2 is a longitudinal sectional view of the present invention.

As shown in FIG. 2, the keycap 20 is of hollow-hat shape and has a plunger 24. The keycap 20 has extrusive skirt 21 on bottom side thereof and two elastic hooks 22 formed on outer side of the extrusive skirt 21. The extrusive skirt 21 has at least one guiding rib 23 on outer side thereof In this embodiment, the extrusive skirt 21 has eight guiding ribs 23 on four outer sidewalls thereof.

Figure 3:
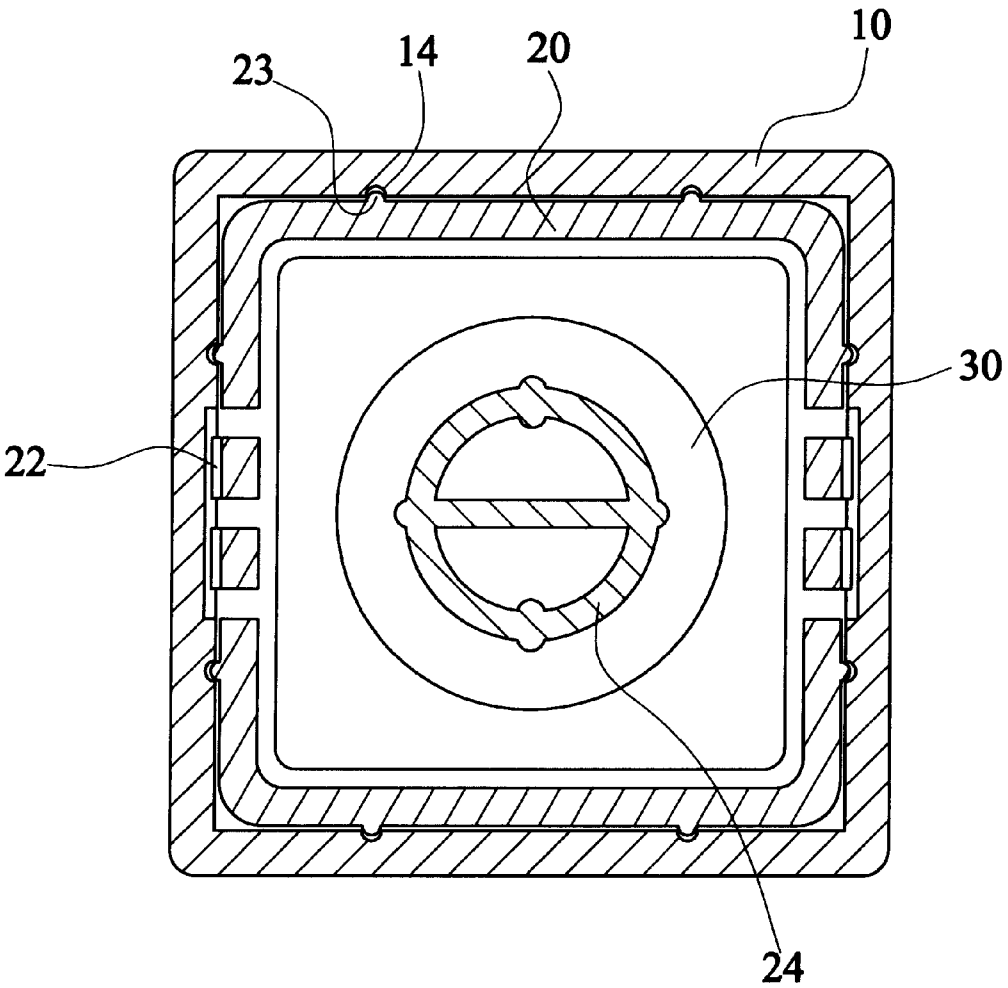
FIG. 3 is a transverse sectional view of the present invention.

As shown in FIG. 2, the keycap 20 is assembled into the mounting hole 12 from the bottom thereof direction and the keycap 20 is movable upward and downward within the mounting hole 12. The extrusive skirt 21 is blocked by a flange 25 on the top end of the mounting hole 12 to confine the motion of the keycap 20 and prevent the ejection of the keycap 20. The two elastic hooks 22 contact the two mute bevels 13 on two inner sides of the mounting hole 12 to reduce striking noise between the keycap 20 and the stage 10. As shown in FIG. 3, the guiding ribs 23 is fit into corresponding guiding groove 14. The thus-assembled keyswitch is arranged on the rubber cone 30, the flexible circuit 40 and base plate 50 of the keyboard.

When the keycap 20 is pressed to lower down the plunger 24, the plunger 24 touches the rubber cone 30. The pressing end 31 of the rubber cone 30 switch on the flexible circuit 40 on the base plate 50. When the keycap 20 is released, the pressing end 31 of the rubber cone 30 leaves the flexible circuit 40 due to the elasticity of the rubber cone 30, thus switching off the flexible circuit 40.

Figure 6:
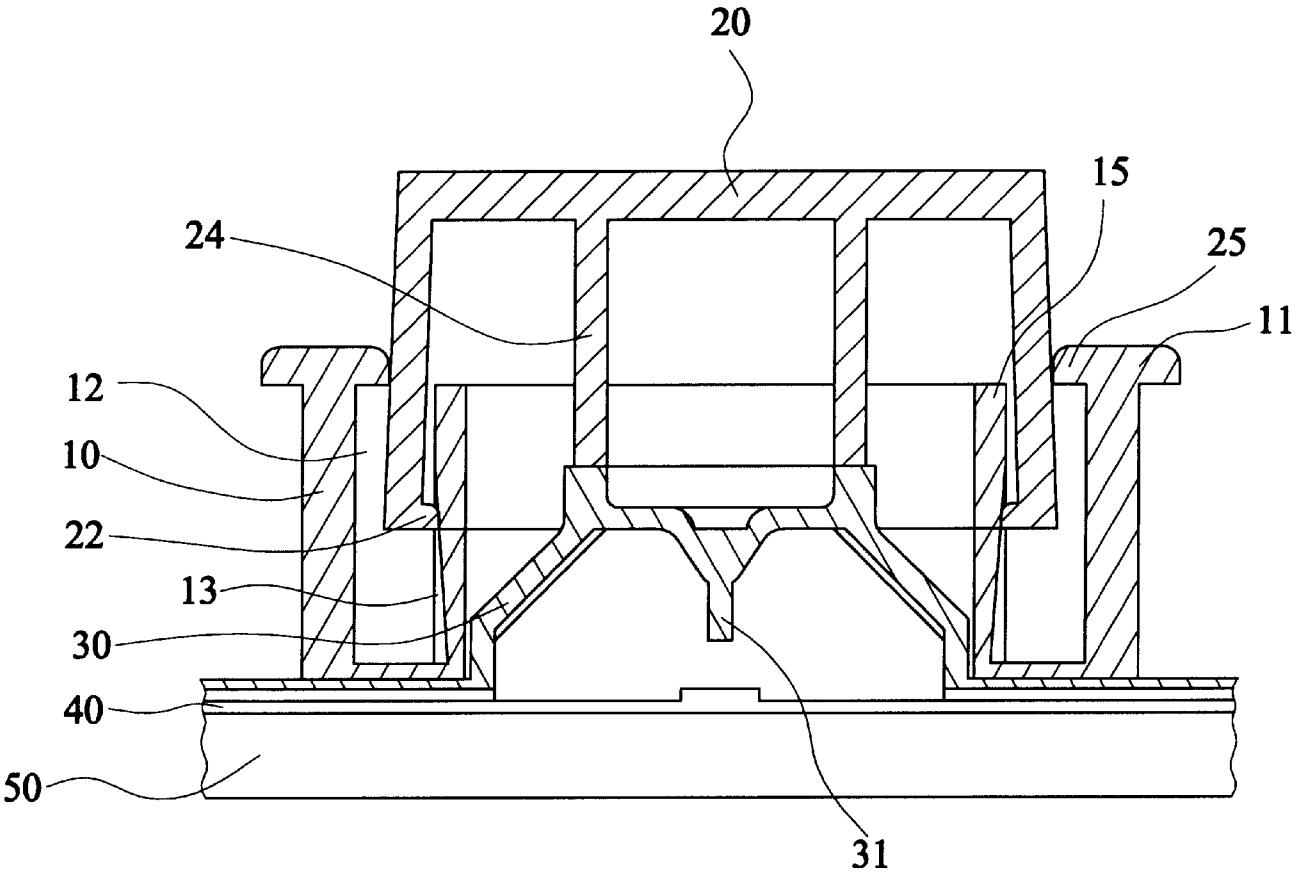
FIG. 6 is a longitudinal sectional view of another preferred embodiment of the present invention.
Figure 7:
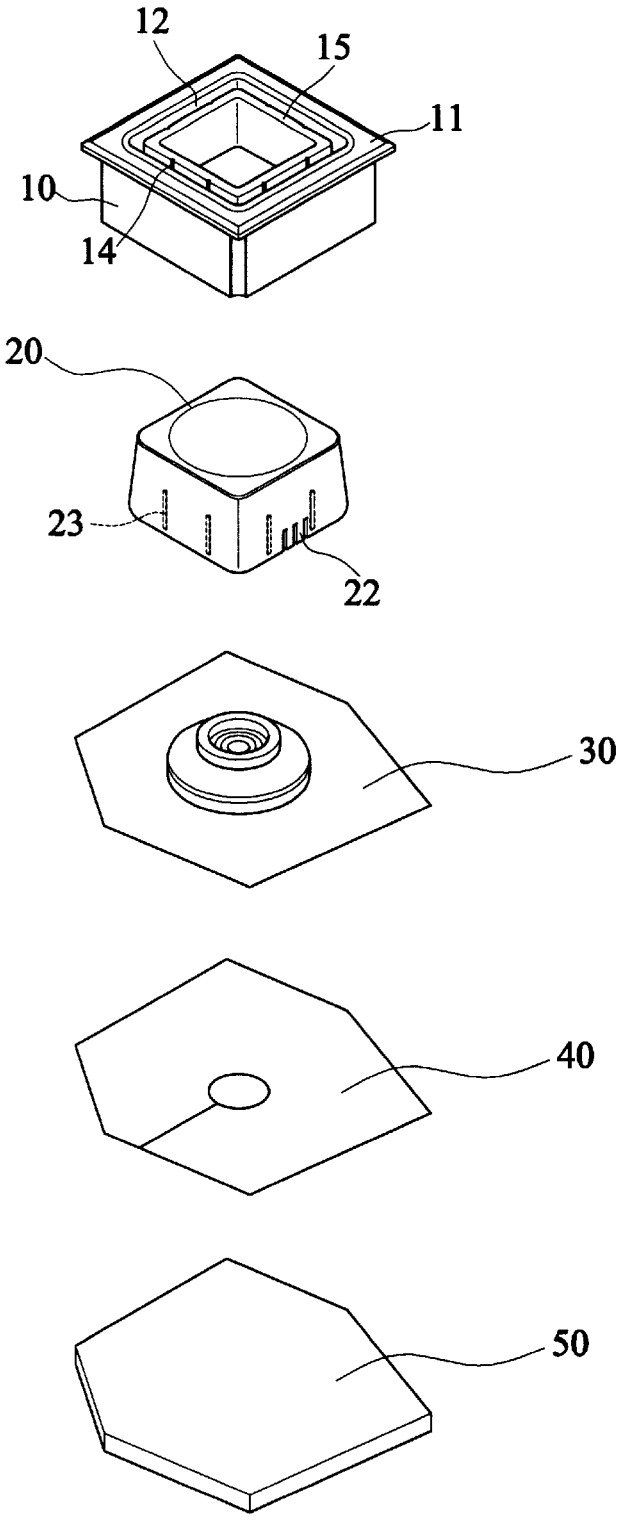
FIG. 7 is an exploded view of another preferred embodiment of the present invention.
Figure 8:
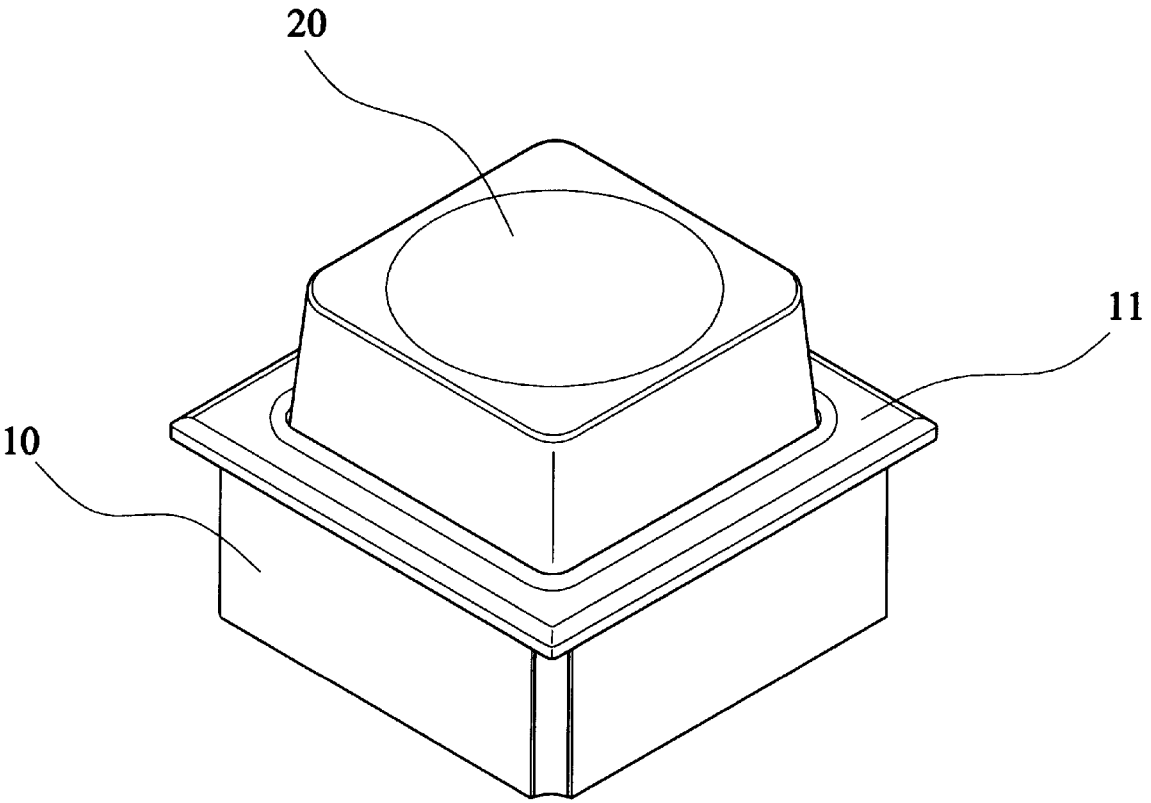
FIG. 8 is a perspective view of another preferred embodiment of the present invention.

FIGS. 7 and 8 show another preferred embodiment of the present invention, in the keyswitch, the mounting hole 12 has an inner stage 15 of hollow cylinder shape therein, The two mute bevels 13 are placed on two opposed inner sides of the inner stage 15, as shown in FIG. 6. The guiding grooves 14 are arranged on the outer side of the inner stage 15, the two elastic hooks 22 are arranged on the inner side of the keycap 20. The keycap 20 is assembled into the mounting hole 12 from top direction and the keycap 20 is movable upward and downward within the mounting hole 12. The two elastic hooks 22 contact the two mute bevels 13 on two inner sides of the mounting hole 12. The guiding ribs 23 are fit into corresponding guiding grooves 14.

Moreover, the position of the guiding ribs 23 and the guiding grooves 14 can be interchanged. That is, the guiding ribs 23 are arranged on the stage 10 and the guiding grooves 14 are arranged on the keycap 20.

The present invention is characterized in that concave groove 14 and convex guiding rib 23 are provided between the stage 10 and the keycap 20. The concave groove 14 and convex guiding rib 22 can restrict vertical movement of the keycap 20 within the stage 10. The keycap 20 is in contact to the stage 10 by the lateral side thereof, the friction is reduced. Moreover, the height of the keyboard is reduced while the key stroke is unchanged.

To sum up, in the present invention, the provision of the concave groove and convex guiding rib can restrict vertical movement of the keycap within the stage. The stability of the keyswitch operation is enhanced and the height of the keyswitch is reduced without shaking problem.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A stable keyswitch comprising:

a stage having a mounting hole and a base surrounding the mounting hole, the base having a flange portion overlaying a portion of said mounting hole; and, a keycap having a plunger extending from a bottom thereof, the keycap being movably arranged within the stage for displacing the plunger, the keycap including a circumferential outwardly extended skirt formed on a lower end thereof, one of the stage within the mounting hole or on a lateral side of the skirt of the keycap being formed with at least one guiding rib thereon, and an opposite one of lateral side of the skirt of the keycap or the stage within mounting hole having at least one groove formed therein corresponding to the at least one guiding rib, the at least one guiding rib being disposed within the at least one groove such that the keycap is movable upward and downward within the mounting hole without shaking, upward movement of the keycap being limited by the skirt contacting the flange portion of the base.

2. The stable keyswitch as recited in claim 1, wherein the keycap is assembled to the stage from beneath the stage.

3. The stable keyswitch as recited in claim 1, wherein the skirt of the keycap and the mounting hole of the stage each includes four sidewalls, each of the four sidewalls of the skirt having a pair of guiding ribs formed thereon and each of the four sidewalls of the mounting hole having a corresponding pair of grooves formed therein for respective receipt of the pair of guiding ribs therein.

4. The stable keyswitch as recited in claim 1, wherein the skirt of the keycap and the mounting hole of the stage each includes four sidewalls, each of the four sidewalls of the mounting hole having a pair of guiding ribs formed thereon and each of the four sidewalls of the skirt having a corresponding pair of grooves formed therein for respective receipt of the pair of guiding ribs therein.

* * * * *